US006354085B1

(12) United States Patent
Howell et al.

(10) Patent No.: US 6,354,085 B1
(45) Date of Patent: Mar. 12, 2002

(54) FUEL INJECTOR WITH A FUEL FILTER ARRANGEMENT FOR A GAS TURBINE ENGINE

(75) Inventors: Stephen J. Howell, Georgetown; Jennifer Waslo, Marblehead, both of MA (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/482,665

(22) Filed: Jan. 13, 2000

(51) Int. Cl.[7] ..... F02C 7/22

(52) U.S. Cl. ..... 60/740; 60/739; 60/39.091; 239/590

(58) Field of Search ..... 60/740, 741, 746, 60/748, 39.091, 39.094, 739; 239/399, 400, 403–406, 590, 590.3, DIG. 23

(56) References Cited

U.S. PATENT DOCUMENTS 2,422,214 A * 6/1947 Meyer et al. ..... 60/740
3,129,891 A * 4/1964 Vdoviak ..... 239/405
3,159,971 A * 12/1964 Moebius et al. ..... 60/740
3,441,223 A * 4/1969 Lapera ..... 239/403
3,472,025 A * 10/1969 Simmons et al. ..... 60/740
4,590,768 A * 5/1986 Halvorsen et al. ..... 60/741
4,609,150 A * 9/1986 Pane, Jr. et al. ..... 239/400
4,655,912 A * 4/1987 Bradley et al. ..... 213/409
4,899,937 A * 2/1990 Haruch ..... 239/590.3
5,167,116 A * 12/1992 Koblish et al. ..... 60/39.06
5,340,032 A * 8/1994 Stegmaier et al. ..... 239/575
5,417,054 A * 5/1995 Lee et al. ..... 60/39.094
6,019,128 A * 2/2000 Reiter ..... 239/DIG. 23

OTHER PUBLICATIONS

"Moeller Advanced Self–Locking Device™", Applications and Design Information, Moeller Mfg. Co., Aircraft Division, Wicom, MI, Locking Device, Literature, Dwg. No. SW31534, Sh. 1.

* cited by examiner

*Primary Examiner*—Ted Kim
(74) *Attorney, Agent, or Firm*—Andrew C. Hess; William Scott Andes

(57) ABSTRACT

A fuel injector for use in a gas turbine engine includes an inlet stem with a bore formed therein and an insert disposed in the bore. The insert has a cavity formed therein for receiving a fuel filter. The use of the insert allows the upstream end of the inlet stem to be connected to a fuel manifold with a double seal fitting.

8 Claims, 3 Drawing Sheets

FUEL INJECTOR WITH A FUEL FILTER ARRANGEMENT FOR A GAS TURBINE ENGINE

BACKGROUND OF THE INVENTION

This invention relates generally to gas turbine engines and more particularly to fuel injectors for supplying fuel to the combustor of such engines.

A gas turbine engine includes a compressor that provides pressurized air to a combustor wherein the air is mixed with fuel and ignited for generating hot combustion gases. These gases flow downstream to one or more turbines that extract energy therefrom to power the compressor and provide useful work such as powering an aircraft in flight. In combustors used with aircraft engines, the fuel is typically supplied to the combustor through a plurality of fuel injectors positioned at one end of the combustion zone, and air is supplied through a surrounding assembly, known as a swirler, which imparts a swirling motion to the air so as to cause the air and fuel to be thoroughly mixed.

Conventional fuel injectors typically include an inlet stem that is mounted to the combustor casing and connected at one end to a fuel manifold. The other end of the inlet stem is connected to a fuel tube that carries the fuel to a fuel tip disposed in the swirler. A fuel filter is located in the inlet stem to remove any contaminants from the fuel stream prior to its introduction to the combustor. Because they are exposed to a relatively high temperature gas stream, fuel injectors are typically provided with some form of thermal protection to prevent overheating of the fuel as it passes through the fuel injector. Excessive heating of the fuel can lead to coke formation, which will cause the fuel injector to become clogged.

In an aircraft engine, a fuel leak could result in a fire and/or loss of power that would jeopardize the safety of the aircraft flight. Thus, it is desirable that the fuel delivery system be resistant to leaks or other failures. It is also desirable to use a one piece fuel manifold because of its relatively low cost. It has thus been proposed to use a double seal fitting to connect the inlet stem to the fuel manifold so that the fuel delivery system meets commercial fire safety standards. A double seal fitting is a known type of fitting that includes locking features for preventing separation of the inlet stem and the fuel manifold due to causes such as vibrations or the like.

However, use of a double seal fitting with a one piece manifold requires that the fuel filter be located further inside the inlet stem than is the case with other types of connections. Prior attempts to configure the inlet stem to accommodate the repositioned fuel filter have encountered problems with the manufacture of the inlet stems and the thermal protection of the fuel passing therethrough. Accordingly, there is a need for a fuel injector that can accommodate a double seal fitting while remaining easy to manufacture and providing adequate thermal protection.

BRIEF SUMMARY OF THE INVENTION

The above-mentioned need is met by the present invention, which provides a fuel injector having an inlet stem with a bore formed therein and an insert disposed in the bore. The insert has a cavity formed therein for receiving a fuel filter.

The present invention and its advantages over the prior art will become apparent upon reading the following detailed description and the appended claims with reference to the accompanying drawings.

BRIEF DESCRIPTION OF THE DRAWINGS

The subject matter which is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
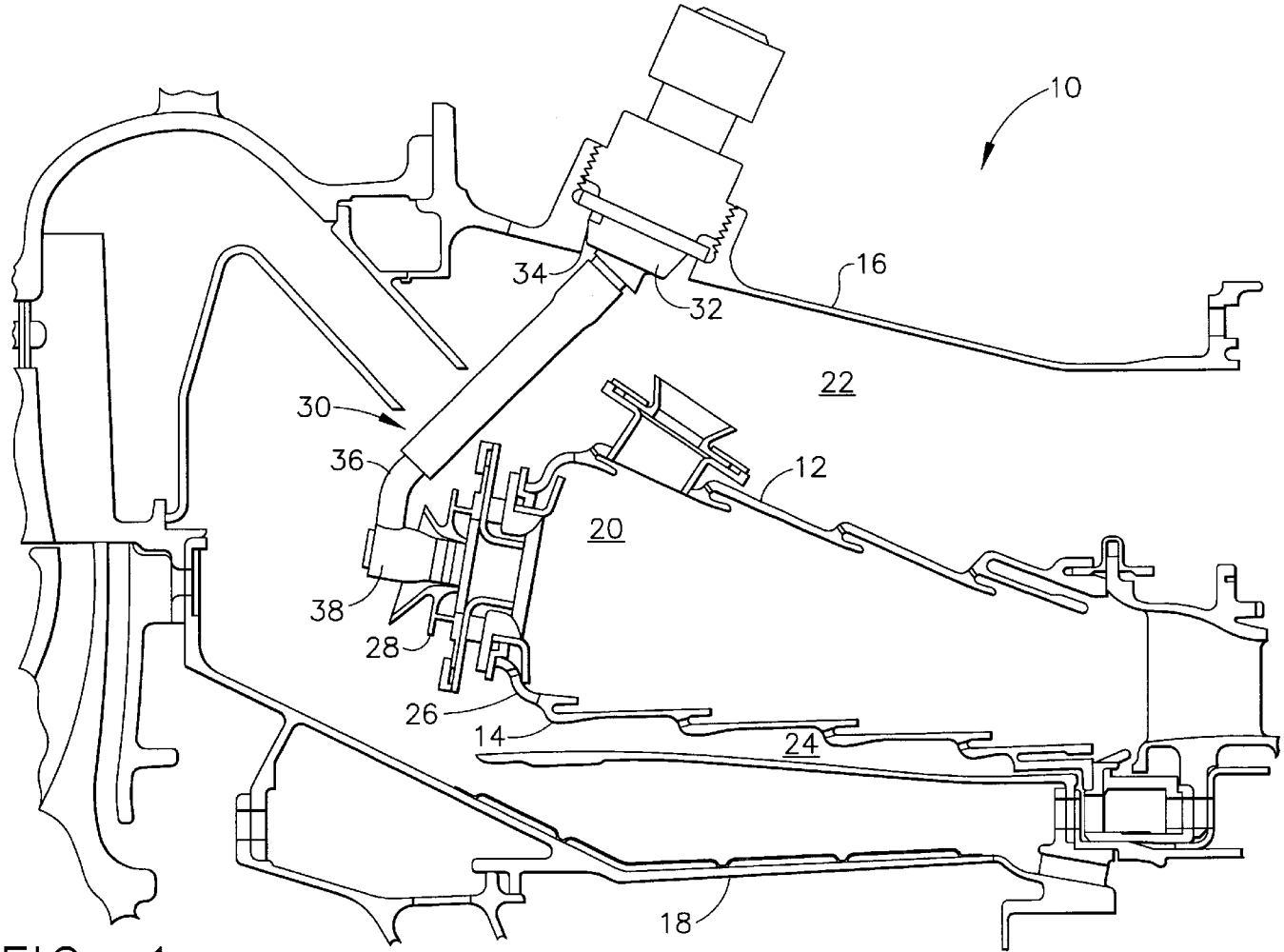
FIG. 1 is a longitudinal sectional view of a gas turbine combustor having the fuel injector of the present invention

Referring to the drawings wherein identical reference numerals denote the same elements throughout the various views, FIG. 1 shows a combustor 10 of the type suitable for use in a gas turbine engine. The combustor 10 includes an outer liner 12 and an inner liner 14 disposed between an outer combustor casing 16 and an inner combustor casing 18. The outer and inner liners 12 and 14 are radially spaced from each other to define a combustion chamber 20. The outer liner 12 and the outer casing 16 form an outer passage 22 therebetween, and the inner liner 14 and the inner casing 18 form an inner passage 24 therebetween. As is known in the art, compressed air is supplied from a compressor (not shown) located upstream of the combustor 10. The compressed air passes principally into the combustor 10 to support combustion and partially into the outer and inner passages 22 and 24 where it is used to cool the liners 12 and 14 and turbomachinery further downstream.

Disposed between and interconnecting the outer and inner liners 12 and 14 near their upstream ends is an annular dome plate 26. A plurality of circumferentially spaced swirler assemblies 28 (only one shown in FIG. 1) is mounted in the dome plate 26. Each swirler assembly 28 has a central opening that coaxially receives a corresponding fuel injector 30. Each fuel injector 30 includes an inlet stem 32 that is mounted in an opening 34 formed in the outer combustor casing 16. The radially outer end of the inlet stem 32 is connected to a conventional fuel manifold (not shown), which is preferably a one piece manifold. The radially inner or downstream end of the inlet stem 32 is connected to a fuel tube 36. Although there may be some occasions when fuel flows radially outward through the fuel injector 30, the primary direction of fuel flow through the fuel injector 30 is radially inward. Thus, as used herein with respect to the fuel injector 30 or any element thereof, the terms downstream end and upstream end refer to the radially inner end and the radially outer end, respectively.

The downstream end of the fuel tube 36 is connected to a fuel tip 38 that is disposed in the central opening of the corresponding swirler assembly 28. Fuel from the fuel manifold passes through the inlet stem 32 and the fuel tube 36 to the fuel tip 38 and is discharged therefrom. The swirler assembly 28 swirls incoming air, which interacts with fuel discharged from the fuel injector 30 so that a thoroughly mixed fuel/air mixture flows into the combustion chamber 20.

Figure 2:
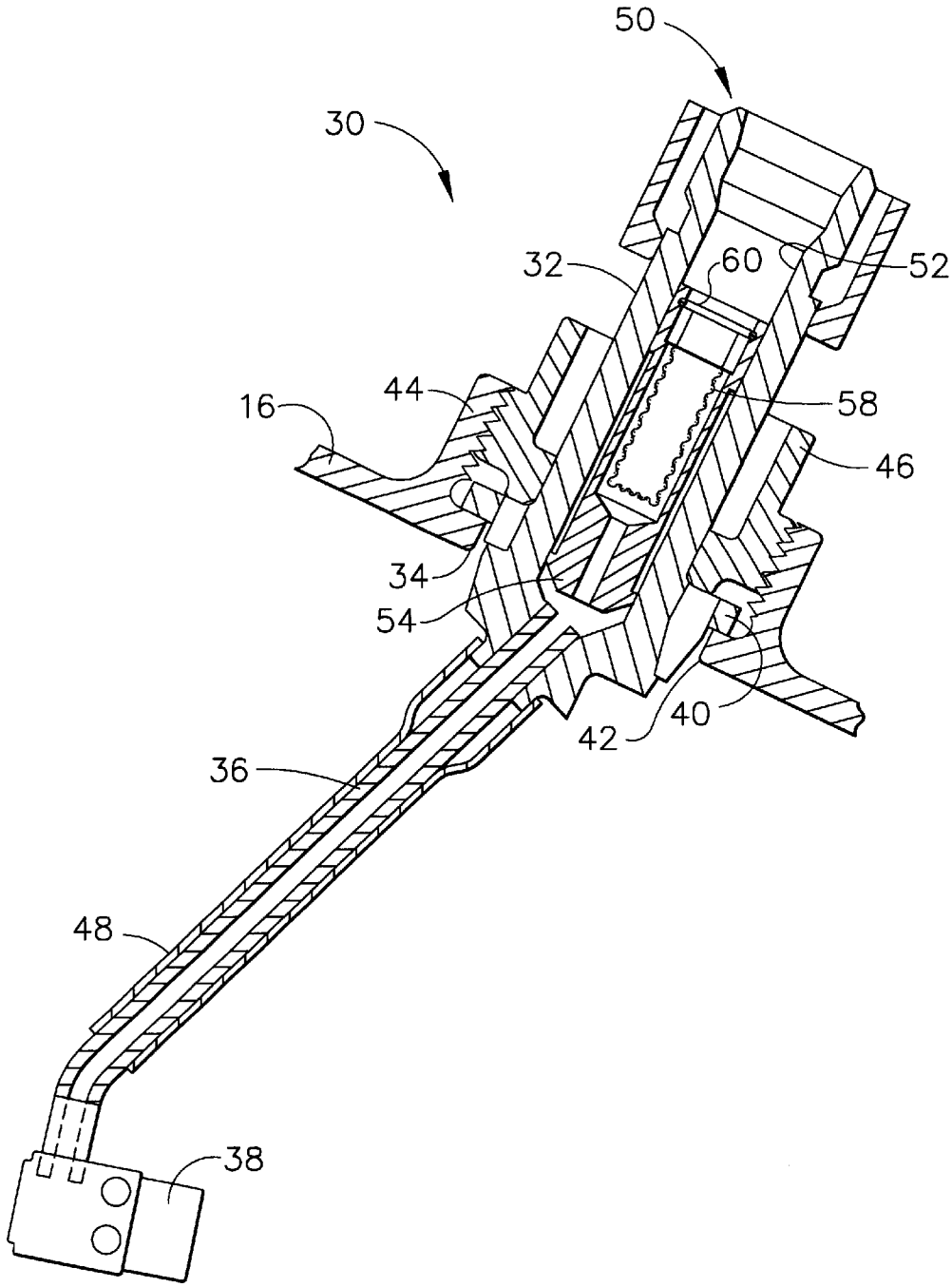
FIG. 2 is a cross-sectional view of the fuel injector of FIG. 1.

Referring to FIG. 2, the fuel injector 30 is shown in more detail. As mentioned above, the inlet stem 32 is mounted in an opening 34 formed in the outer combustor casing 16. The inlet stem 32 is a substantially cylindrical member having an annular flange 40 formed near its downstream end. The flange 40 is sized to engage a lip 42 defined by the opening 34. A cylindrical boss 44 having internal threads formed therein is formed on the outer combustor casing 16 around the opening 34. A hold down nut 46 having external threads formed thereon threadingly engages the boss 44 and abuts the flange 40 so as to secure the inlet stem 32 to the outer combustor casing 16.

The downstream end of the inlet stem 32 is connected to the fuel tube 36, which is enclosed by a heat shield 48 for thermally protecting the fuel passing therethrough. The upstream end of the inlet stem 32 is preferably connected to the fuel manifold by means of a conventional double seal fitting, shown generally at reference numeral 50, having self-locking capability such as those commercially available from the Moeller Manufacturing Co., Inc. of Wixom, Mich. One such fitting is described in U.S. Pat. No. 5,083,819 issued Jan. 28, 1992 to Kurt K. Bynum. The upstream end of the inlet stem 32 is appropriately configured to accommodate the double seal fitting 50.

The substantially cylindrical inlet stem 32 has a longitudinal bore 52 formed therethrough. A substantially cylindrical insert 54 is disposed in the bore 52. The insert 54 has a cavity 56 formed therein for receiving a cylindrical fuel filter 58. The fuel filter 58 is retained in the cavity 56 by a retainer 60 such as a circlip or the like. The retainer 60 is received within a groove 61 (see FIG. 3) formed in the upstream end of the cavity 56.

Figure 3:
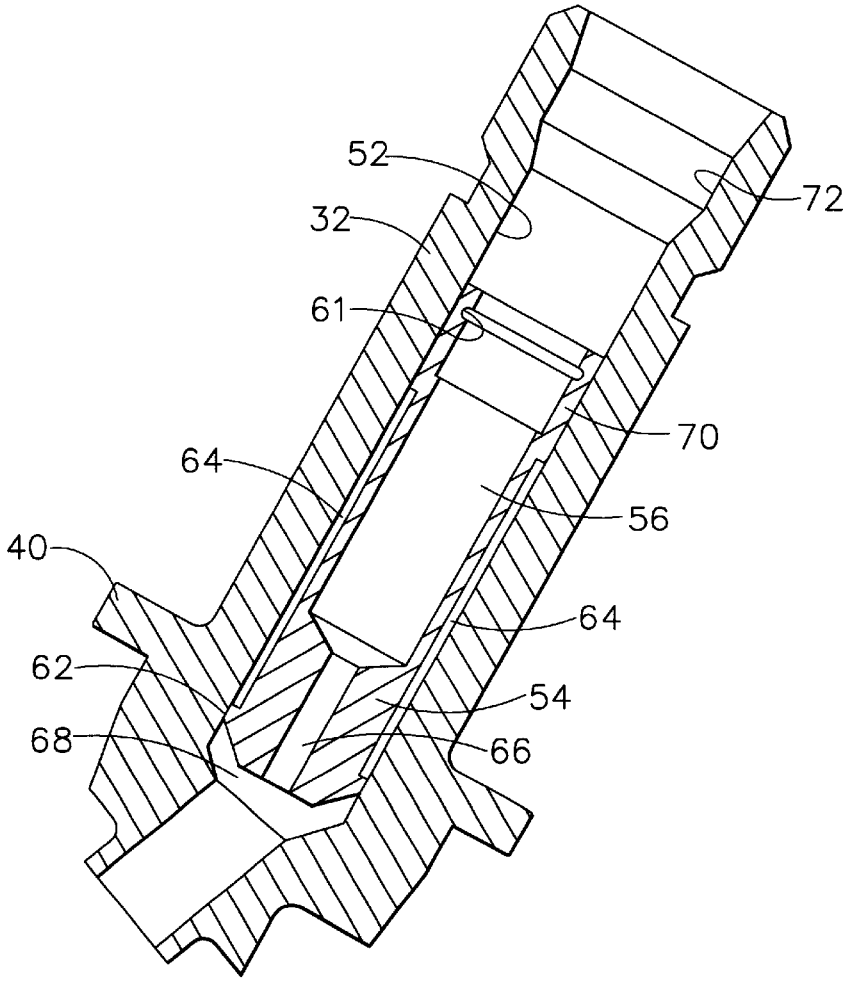
FIG. 3 is a detailed view of the inlet stem and insert from the fuel injector of FIG. 2.

Turning now to FIG. 3, the inlet stem 32 and insert 54 are shown in detail with the other components removed for clarity. The upstream end of the insert 54 is joined to the inner surface of the inlet stem bore 52, preferably by brazing, as identified by reference numeral 70. A small annular land 62 is formed on the insert 54 near its downstream end to radially position and stabilize the insert 54 within the bore 52. The rest of the insert 54 is sized so that the insert 54 and the inlet stem 32 define an insulating gap 64 therebetween that surrounds the insert 54. The insulating gap 64 minimizes heat flux from the outer combustor casing 16 and the hot gas flow therein to the fuel by restricting both conduction and convection. Conduction through the land 62 is minimal because of its very small contact area with the inlet stem 32. The braze joint 70 at the upstream end of the insert 54 defines a larger contact area, but conduction through this joint 70 is minimized because it is located far away from the hot outer combustor casing 16 and the flange 40, thereby increasing the conduction path length.

The cavity 56 extends longitudinally into the insert 54 from its upstream end and is of sufficient size to receive the fuel filter 58 (not shown in FIG. 3). A passage 66 extends from the bottom of the cavity 56 to the downstream end of the insert 54. The passage 66 is thus in fluid communication with the cavity 56 so as to permit fuel to flow through the length of the insert 54. The passage 66 is narrower than the cavity 56. Because of its narrow diameter, the passage 66 increases the rate at which fuel flows through it (i.e., decreases fuel residence time) during steady state and shutdown operations, thereby further reducing heat transfer to the fuel. The volume of the end cavity 68 defined between the downstream end of the insert 54 and the inlet stem 32 is kept small so as to avoid fuel stagnation zones and preserve fuel fill and purge times.

The upstream end of the insert 54 is positioned relatively far inside the bore 52 so as to be located remote from (i.e., not adjacent to) the upstream end of the inlet stem 32. Thus, the upstream end of the insert 54 is axially spaced from the upstream end of the inlet stem 32 by a predetermined distance. This provides a sufficient axial space 72 in the upstream end of the bore 52 to receive the mating structure (not shown) of the fuel manifold for connection to the inlet stem 32 via the double seal fitting 50.

The foregoing has described a fuel injector that can accommodate a double seal fitting for connection to a one piece fuel manifold. Using a novel insert to the inlet stem provides a fuel injector that is producible and requires minimal manufacturing changes to existing inlet stem designs. The fuel injector can also accommodate the current fuel filter. Thermal insulation of the fuel is improved during steady state and shutdown operation, and fuel volume is preserved, maintaining fill and purge times. The cost of the fuel injector of the present invention is reduced from that of current commercial fuel injectors.

While specific embodiments of the present invention have been described, it will be apparent to those skilled in the art that various modifications thereto can be made without departing from the spirit and scope of the invention as defined in the appended claims.

What is claimed is:

1. A fuel injector for a gas turbine engine having a combustor casing, said fuel injector comprising:

an inlet stem having a first end, a second end and a bore formed therethrough, said inlet stem being mounted to said casing;

an insert disposed entirely in said bore, said insert having an upstream end, a downstream end, a longitudinal axis, a cavity extending into said insert from said upstream end thereof and a passage extending from said cavity to said downstream end thereof;

a filter disposed entirely in said cavity; and a double seal fitting for connecting said first end of said inlet stem to a fuel manifold, said upstream end of said insert being axially positioned within said bore so as to define sufficient axial space between said upstream end of said insert and said first end of said inlet stem to receive said double seal fitting.

2. The fuel injector of claim 1 wherein said inlet stem and said insert define a gap that surrounds said insert.

3. The fuel injector of claim 2 wherein said insert has a land formed on said downstream end thereof, said land contacting said inlet stem so as to maintain said gap.

4. The fuel injector of claim 3 wherein said upstream end of said insert is joined to said inlet stem.

5. The fuel injector of claim 1 wherein said passage is narrower than said cavity.

6. The fuel injector of claim 1 further comprising a retainer for retaining said filter in said cavity.

7. The fuel injector of claim 6 wherein said insert has a groove formed therein for receiving said retainer.

8. The fuel injector of claim 1 further comprising a hold down nut that threadingly engages said casing and abuts said inlet stem to secure said inlet stem to said casing.

* * * * *